US005478148A

United States Patent [19]

Thomas et al.

[11] Patent Number: 5,478,148

[45] Date of Patent: Dec. 26, 1995

[54] OSCILLATING STIRRING APPARATUS FOR MIXING VISCOUS PRODUCTS AND OR FLUIDS

[75] Inventors: Dominique C. A. Thomas, Le Creusot; Pierre Delorme, Chalon Sur Marne, both of France

[73] Assignee: SEVA, Chalon Sur Saone, France

[21] Appl. No.: 341,063

[22] Filed: Nov. 16, 1994

[30] Foreign Application Priority Data

Nov. 18, 1993 [FR] France ..... 93 13970

[51] Int. Cl.[6] ..... B01F 7/00

[52] U.S. Cl. ..... 366/241

[58] Field of Search ..... 366/96–98, 100, 366/241–244, 261, 275, 279, 342, 343, 349

[56] References Cited

U.S. PATENT DOCUMENTS

| | | | |
|---|---|---|---|
| 3,116,878 | 1/1964 | Reiter | 366/279 X |
| 3,171,721 | 3/1965 | Strathearn et al. . | |
| 3,201,094 | 8/1965 | Ligon et al. | 366/261 |

FOREIGN PATENT DOCUMENTS

| | | |
|---|---|---|
| 1208222 | 2/1960 | France . |
| 1393014 | 3/1965 | France . |
| 1550813 | 12/1968 | France . |
| 2486820 | 1/1982 | France . |
| 205468 | 9/1939 | Switzerland . |
| 610974 | 10/1948 | United Kingdom . |

OTHER PUBLICATIONS

Soviet Invention Illustrated, Derwent Publications, SU 1000–084–A, Don Coal, Feb. 1984.

Soviet Inventions Illustrated, Derwent Publications, SU 1134–225–A, Belyakov AG, Sep. 1985.

*Primary Examiner*—Charles E. Cooley

*Attorney, Agent, or Firm*—Sughrue, Mion, Zinn, Macpeak and Seas

[57] ABSTRACT

A fluid tight container 11 defines a conical internal cavity 35, and has an upper feed pipe 12 and a lower outlet opening 14. A cylindrical stirrer 15 is wholly enclosed in the cavity, and is driven in a circular oscillating manner by an external eccentric mechanism coupled to an extension of the stirrer. This arrangement makes it possible to mix products of high viscosity and gas without excessive heating and leakage, by virtue of the exclusive use of static fluid-tightness.

4 Claims, 2 Drawing Sheets

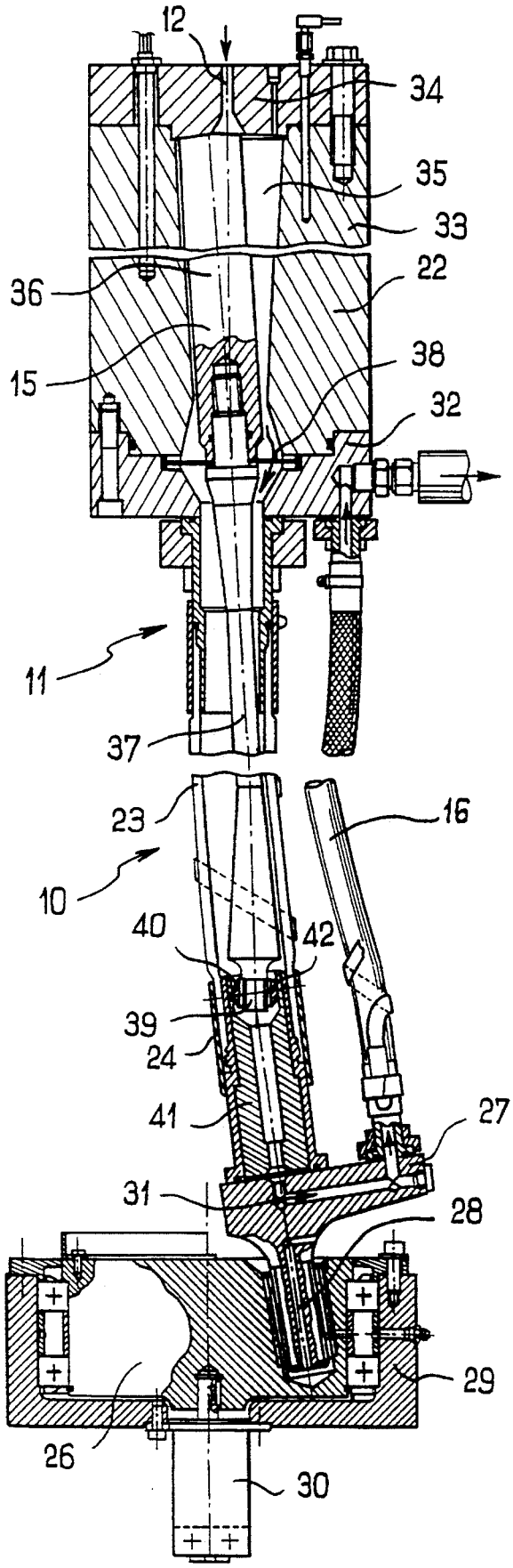
12
34
35
33
36
22
15
38
32
11
37
23
16
10
40
42
39
24
41
27
31
28
29
26
30

OSCILLATING STIRRING APPARATUS FOR MIXING VISCOUS PRODUCTS AND OR FLUIDS

BACKGROUND OF THE INVENTION

This invention relates to an apparatus for mixing viscous products and/or fluids, and comprises a fluid-tight container having at least one outlet orifice. The container houses the products to be mixed, and has a stirring mechanism to mix them.

French patent No. 1,208,222 discloses a device comprising a cylindrical container, along the axis of which the shaft of a stirring mechanism is mounted. The shaft incorporates radially-arranged mixing wires, bars, etc. The stirring mechanism is driven by any type of motor, e.g., an electric or compressed air motor. A product feed pipe and a compressed air duct empty into a mixing chamber. A passage connects the mixing chamber to an expansion chamber, which is in turn connected by a pressure reduction valve and an elongated diaphragm, e.g., a narrow tube, to the mixing chamber, which is under normal pressure. The stirring mechanism is also mounted in the mixing chamber, and is attached to the stirring apparatus mounted in a mixing cylinder. Several pipes, e.g., a pipe for the feed of hardening agents and comprising a proportioning and control valve, empty into the mixing chamber, into which an extension, e.g., a tube serving as an elongated nozzle, may be fitted.

The device according to this French '222 patent uses dynamic joints between the stirring mechanism shaft and the container, thereby limiting the functional pressure to 100 bars. The pressure generates a pronounced frictional stress exerted by the joints on the shaft, thereby generating heat that is sometimes harmful to the products and, at the same time, increases the motor output. Since the products are not necessarily lubricants, the joints have a limited life. Leaks occur continuously at the joints, and prove unacceptable when dangerous products or gases are used. Finally, this system generates a thrust by virtue of a thrustor effect resulting from the output of the rotor rod. Compensation must therefore be made for this thrust.

SUMMARY OF THE INVENTION

The present invention solves these difficulties and provides various advantages, which lie mainly in the fact that the product flows in one direction; i.e., it is systematically swept and circulates through the entire device without any variation or loss of head, whatever the position of the stirring mechanism in the resting or operating state.

To this end, an object of the invention is to provide a mixing device of the aforementioned type, wherein the stirring mechanism is completely enclosed in the container.

According to other features of the device:

the stirring mechanism is guided by at least one swiveling system, such as an elastic washer or ball joint;

the stirring mechanism is driven in circular translational motion by means of the swiveling system;

the stirring apparatus comprises a control arm linked to a cylindrical part by means of a first swiveling system, such as an elastic washer, at one of its ends, and, at the other end, comprises a second swiveling system to which is transmitted the motion emanating from a motor by means of a cam fastened to the part of the container containing the control arm, this part of the container being flexible;

a portion of the interior of the container containing the cylindrical part has a tapered configuration;

the inlet orifice is centered in relation to the circular translational motion of the control arm linked to the cylindrical part belonging to the stirring mechanism; the feed pipe and the outlet orifice are each positioned respectively at one end of the container;

the outlet orifice is located substantially within the extension of the stirring mechanism; and a flexible tube carrying the mixed product coming from the outlet orifice is arranged substantially parallel to the flexible portion of the container.

This invention also concerns equipment for manufacturing objects made of a foamed material, of the type incorporating a plate in contact with a fluid tight cylinder equipped with a compressed gas-feed pipe, a vent pipe, and an outlet pipe equipped with a pump. The outlet pipe is connected to a mixing device which feeds an extrusion nozzle, as specified above.

The invention further relates to the use of an apparatus as described above for mixing products under pressures of up to 300 bars, without leakage, to form objects made of a foamed material, such as static sealing joints positioned in situ or by transfer.

BRIEF DESCRIPTION OF THE DRAWINGS

FIG. 2 is a view in vertical cross-section of an apparatus used to mix products in the apparatus of FIG. 1.

DETAILED DESCRIPTION OF THE PREFERRED EMBODIMENT

Figure 1:
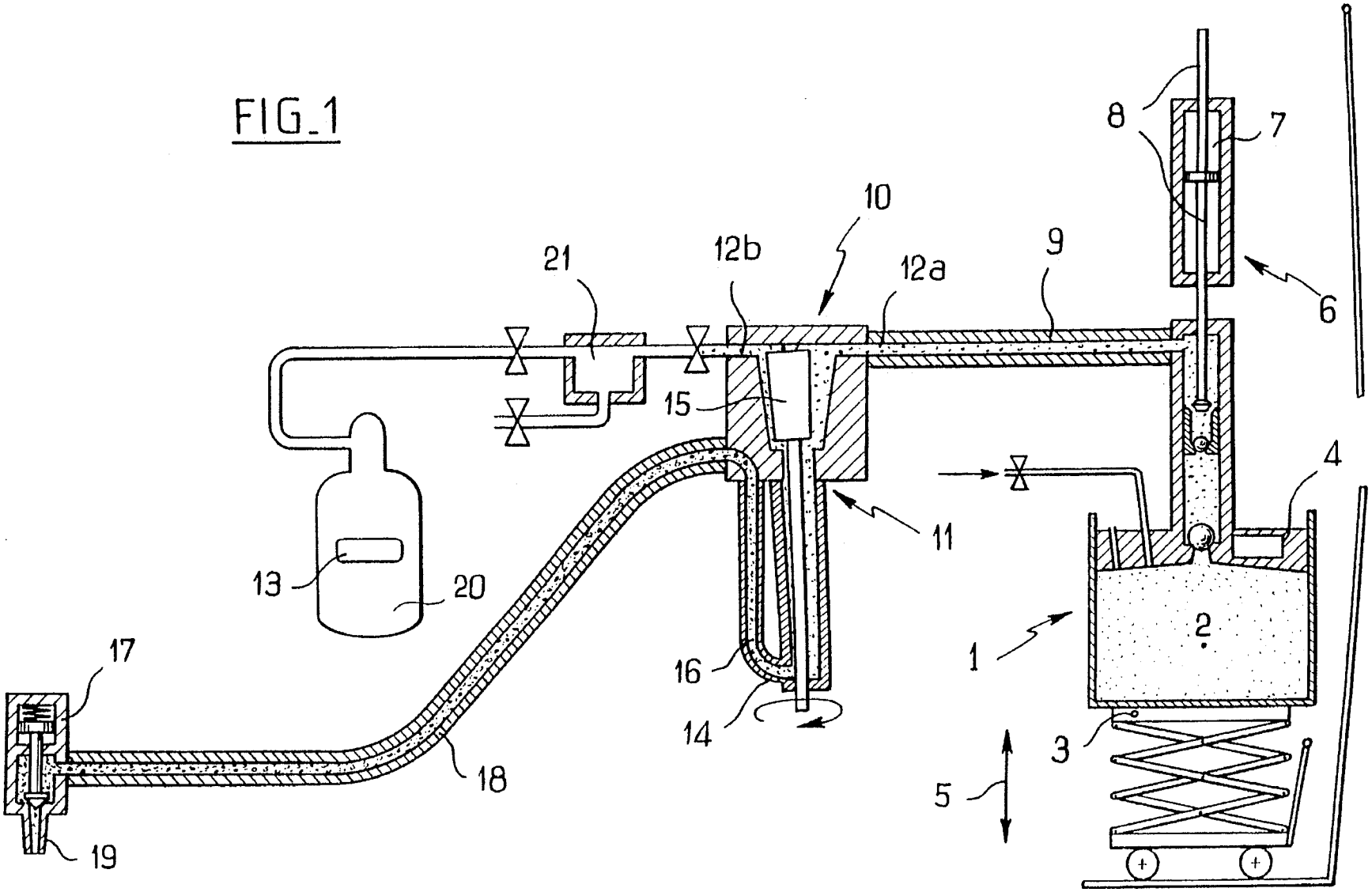
FIG. 1 is a schematic view in vertical cross-section of an apparatus for manufacturing objects made of a foamed material, according to the invention.

The apparatus shown in FIG. 1 comprises a cylinder 1 forming a tank for a viscous thermoplastic product 2, and an elevating platform 3. The tank is sealed by a heating plate 4. The elevating platform is in contact with the product 2 and the heating plate 4 by means of a hydraulic jack shown schematically at 5. A lift and force pump 6 actuated by a hydraulic jack 7 incorporating dual rods 8 is mounted on the plate 4.

The heating plate 4 is connected by a pipe 9 to a mixing device 10 comprising a fluid-tight container 11 equipped with a feed pipe 12*a* used for the viscous product 2, a feed pipe 12*b* for nitrogen 13, and an outlet orifice 14. The container 11 incorporates a stirring mechanism 15. A flexible tube 16 arranged substantially parallel to the lower part of the stirring mechanism is connected to the outlet orifice 14. The tube 16 is connected to a gun 17 by a pipe 18. The gun 17 comprises an extrusion nozzle 19. The nitrogen 13 is contained in a bottle 20 connected to a compressor 21, which is in turn connected to the feed pipe 12*b*.

In operation, the tank 1 is put in place and centered on the elevating platform 3, which keeps the product 2 in contact with the plate 4 under constant force generated by the jack 7. The product is fed directly into the mixing device 10 through the feed pipe 12*a*. The nitrogen 13 from the bottle 20 is fed into the hydropneumatic compressor 21, which increases the pressure to 300 bars. The pressurized nitrogen is fed into the mixing device 10 through the feed pipe 12*b*. The product 2 and the nitrogen 13 are mixed by the motion generated by the stirring mechanism 15 in the container 11. Under the effect of temperature and pressure, the product 2 containing the dissolved nitrogen is made to circulate through the pipe 18 to the gun 17, which extrudes it to form a sealing joint which becomes cross-linked when exposed to moisture on the part to which it adheres.

The mixing device 10 used in the apparatus described above and illustrated in FIG. 2 comprises a container 11 incorporating an upper rigid part 22 and a lower flexible part 23 joined by a ring fastener 24 to a cam or eccentric 26 via a base 27 having a cylindrical protruding part 28 housed in an offset configuration and slightly inclined in relation to the axis of the cam. The cam is mounted so as to rotate freely in a frame 29. A motor 30 positioned beneath the frame 29 is connected to and drives the cam 26.

The base 27 comprises a duct 31 originating in the lower part of the container 11 and emptying into the flexible tube 16. The rigid part 22 of the container is made of two superposed elements 32, 33 closed by a cover 34. The internal cavity 35 of the element 33 has a partially tapered shape which flares toward the cover 34. The stirring mechanism 15 comprises a cylindrical rod 36 threaded to the upper end of a control arm 37. The rod 36 is housed in the internal cavity 35. The control arm 37 is partially housed in the flexible portion 23 of the container 11. An elastic washer 38 incorporating holes is inserted in the internal portion of the rigid part 22 of the container 11, at the junction of the control arm 37 and the rod 36. The control arm 37 is connected at its lower end 39 to the base 27 by means of a ball joint 40 housed in a hollow cylindrical element 41. The ball joint 40 has holes 42 opening into the hollow element 41.

As the motor 30 rotates the cam 26, the assembly of the base 27 and its protruding part 28 journaled in the cam, the hollow cylindrical element 41 and the ball joint 40 is driven in a conical path, with the ball joint 40 transcribing a circle. This in turn drives the stirring rod 36 and the control arm 37 in separate conical paths, inverted relative to each other with their apices meeting at the flexible washer 38, which serves as a swivel point or fulcrum.

We claim:

1. An apparatus for mixing viscous products and fluids, comprising:

a) an elongate, fluid-tight container (11) having a rigid member (22) extended at one end by a flexible tubular member (23), the rigid member defining an open conical mixing chamber (35) therein and having a centrally disposed inlet passage (12) at another, opposite end, b) a rigid, cylindrical stirring rod (36) disposed in the mixing chamber and extended at one end, adjacent said one end of the rigid member, by a rigid, elongate control arm (37) disposed within the flexible member with clearance, c) first apertured swivel means (38) coupled between said one ends of the rigid member and the stirring rod for:

1) enabling a circular translational movement of the rod within the conical mixing chamber, with the swivel means serving as a fulcrum for such movement, and 2) enabling a flow of mixed products and fluids from the chamber into the flexible member, d) drive means (26,29,30) having output means (27,28,41) defining a circular path of movement, e) second apertured swivel means (24,40) coupling outermost ends of the flexible member and the control arm to the output means, and f) an outlet passage (31) defined within the output means, g) wherein a continuous fluid-tight flow path is provided from the inlet passage to the outlet passage without any dynamic seal leakage sources.

2. An apparatus according to claim 1, wherein said first and second apertured swivel means comprise an elastic washer and a ball joint, respectively.

3. An apparatus according to claim 1, wherein the inlet passage and the outlet passage are disposed at opposite ends of the flow path.

4. An apparatus according to claim 1, further comprising a flexible tube (16) for transporting the mixed products and fluids flowing from the outlet passage positioned substantially parallel to the flexible tubular member of the container.

* * * * *